US006176408B1

(12) United States Patent
Miner et al.

(10) Patent No.: US 6,176,408 B1
(45) Date of Patent: Jan. 23, 2001

(54) HELMET BACKPACK

(76) Inventors: Gregory Lawrence Miner, 5095 Bobbie Ave., San Jose, CA (US) 95130; William Casey Gordon Potter, 5341 Southbridge Pl., San Jose, CA (US) 95118

( * ) Notice: Under 35 U.S.C. 154(b), the term of this patent shall be extended for 0 days.

(21) Appl. No.: 09/452,281

(22) Filed: Nov. 30, 1999

Related U.S. Application Data

(63) Continuation-in-part of application No. 08/949,985, filed on Oct. 14, 1997, now abandoned.

(51) Int. Cl.[7] ..... A45F 5/00; A45F 3/04

(52) U.S. Cl. ..... 224/653; 224/580; 224/576; 224/627; 224/629; 224/644; 224/153

(58) Field of Search ..... 224/153, 583, 224/578, 579, 580, 627, 628, 629, 630, 640, 642, 645, 650, 652, 653, 654, 657, 264, 907, 655, 576, 577; 190/103, 109, 112; 383/118; 2/171.2; 428/187

(56) References Cited

U.S. PATENT DOCUMENTS

| | | | | |
|---|---|---|---|---|
| 1,397,161 | * | 11/1921 | Clemetson | 224/579 |
| 3,530,919 | * | 9/1970 | May | 224/579 X |
| 3,938,716 | * | 2/1976 | Jackson et al. | 224/153 |
| 4,236,615 | * | 12/1980 | Ginat | 190/103 X |
| 4,561,576 | * | 12/1985 | Lowe et al. | 224/579 X |
| 4,764,962 | * | 8/1988 | Ekman et al. | 224/655 X |
| 4,883,207 | * | 11/1989 | McArthur | 224/644 |
| 5,149,388 | * | 9/1992 | Stahl | 428/187 |
| 5,255,834 | * | 10/1993 | Bendersky | 224/907 |
| 5,265,719 | * | 11/1993 | Wand | 190/125 X |
| 5,265,784 | * | 11/1993 | Gregory | 224/601 |
| 5,356,002 | * | 10/1994 | Brown | 190/111 X |
| 5,370,287 | * | 12/1994 | Cormier | 224/153 |
| 5,509,589 | * | 4/1996 | Kliot | 224/653 X |
| 5,557,807 | * | 9/1996 | Hujar et al. | 2/171.2 |
| 5,570,829 | * | 11/1996 | Harrison | 224/153 |
| 5,632,429 | * | 5/1997 | Cantwell | 224/643 |
| 6,095,389 | * | 8/2000 | Fenton et al. | 224/627 |

FOREIGN PATENT DOCUMENTS

| | | | | |
|---|---|---|---|---|
| 154365 | * | 7/1932 | (CH) | 224/153 |
| 607133 | * | 8/1948 | (GB) | 190/103 |
| 835030 | * | 8/1948 | (FR) | 190/109 |

* cited by examiner

*Primary Examiner*—Gregory M. Vidovich
(74) *Attorney, Agent, or Firm*—James J. Leary; Patrick T. Reilly; Carol D. Titus

(57) ABSTRACT

A helmet backpack is provided to carry a helmet. A helmet enclosure combined with strapping form the helmet backpack. A helmet is inserted through an opening of the enclosure and secured with a zipper assembly, buttons and buttonholes, hook-and-loop fasteners, such as VELCRO strips, a drawstring assembly and/or other closure. The strapping is used by a wearer to position and hold the enclosure on his or her back. The strapping may be adjustable in length for greater user comfort. Detachable straps are also allowed for, whereby the helmet backpack strap or straps may be removed or strapped in typical backpack style or worn across the wearer's chest in a bandoleer style. Certain models include pouches which may be located either internal or external to the helmet or to the enclosure. Padding is utilized to increase protection to the helmet and to reduce discomfort to the user. Certain models include a grab handle and/or a hook for handling or storing the enclosure or for attaching the enclosure to a belt or garment.

29 Claims, 8 Drawing Sheets

HELMET BACKPACK

CROSS REFERENCE TO OTHER APPLICATIONS

This application is a continuation-in-part of U.S. utility patent application, Ser. No. 08/949,985, filed Oct. 14, 1997, now abandoned.

FIELD OF THE INVENTION

The present invention relates to backpack type carrying devices and more particularly to a device specifically designed for transporting helmets.

BACKGROUND OF THE INVENTION

The helmet design and manufacturing industry strives to provide protective and attractive head gear for motorcyclists and bicyclists. These products are often decorated with corporate and brand name logos and signage. The price or economic value of a helmet can be relatively high depending upon market demand. The market value of a particular helmet can be determined by its effectiveness in head protection, weight, aesthetic appeal and prestige value of any distinctive decoration or signage. Motorcycle and bicycle riders commonly use their vehicles to transport themselves to distant locations, where it is inadvisable to leave a helmet unattended. Yet helmets are typically bulky objects that are awkward to carry when not in use. There has been a long felt need for an accessory device that allows a helmet wearer to conveniently transport a helmet with his or her person when dismounted and away from his or her vehicle.

Examples of specialized backpacks for carrying folding chairs or for providing protective clothing can be found in the Harrop, U.S. Pat. No. 5,544,793, which discloses a backpack for carrying a folding lawn chair, and Greenberger, U.S. Pat. No. 5,526,969, which discloses a backpack that is convertible between a backpack only mode and a backpack and protective outerwear mode.

SUMMARY OF THE INVENTION

It is an object of the present invention to provide a helmet backpack that is especially adapted for carrying a helmet. Specific embodiments of the present invention may be adapted to transport, carry and/or store rigid and/or military helmets, sports helmets, motorcycle helmets and/or bicycle helmets. The helmet backpack includes an enclosure for holding the helmet, an opening through which the helmet is inserted and removed, and strapping which is attached to the enclosure. The enclosure comprises a shell and a backing. The backing is positioned against the back of a user where the helmet backpack is being worn as a backpack. The shell and backing together secure the helmet within the helmet backpack. The shell material may be soft and conform to the shape of an enclosed helmet. Shells of this type are manufactured of spandex, neoprene or other suitable fabrics. Alternatively, components of the shell and enclosure may also include hard materials such as carbon fiber, fiberglass, or other suitable material known in the art, which maintain a rigid shape. Various embodiments of the shell and backing incorporate combinations of hard and soft fabrics and materials with or without foam-over-molding construction and/or optically transparent materials. Certain preferred embodiments of the present invention may incorporate open windows or apertures where a portion or portions of the secured helmet are exposed.

An opening is located on the enclosure and provides the user with a means to insert and remove the helmet from the helmet backpack. In certain embodiments of the helmet backpack, the opening includes a closure device for securing the helmet within the enclosure and inhibiting the unintended exit of the helmet from the enclosure. Various closure devices employ a drawstring, an elastic drawstring, a zipper, buttons with buttonholes, hook-and-eye assemblies, hook-and-loop fasteners, such as VELCRO strips, snaps or other suitable closing features or mechanisms.

Optionally, the backing of the helmet backpack may include soft padding to increase protection to the helmet and wearing comfort to the user. Alternatively, the backing may provide a rigid or semi-rigid framework which conforms to the back of a user and reduces discomfort caused by the rubbing of an enclosed helmet against the back of a helmet backpack wearer.

The strapping includes one or more straps and is used to attach the helmet backpack around the body of a wearer. The strapping is constructed of strong and flexible material such as canvas, nylon mesh or other suitable material. Certain preferred embodiments of the strapping include compression molding sections, as may portions of the enclosure as well. The strapping may be adjustable in length. This feature of adjustment allows for improved wearing comfort of the helmet backpack. Furthermore, the strapping may be detachable. The strapping may, in certain preferred embodiments of the present invention, be used to attach and secure the helmet backpack to a motorcycle for transportation. Certain versions of the present invention provide strapping that is also used as a handle for carrying the helmet backpack by hand.

Optionally, the helmet backpack may include additional features such as pockets, dual or multi-purpose strapping, additional storage compartments, a grab handle and/or an attachment hook. Pockets may be located on the inside or the outside of the enclosure, or as components of the strapping. The interior volume of a helmet contained within the enclosure is a particularly valuable location for a pocket. Certain versions of the helmet backpack include a pocket or pockets that reside within this interior volume of a helmet where the helmet is contained within the enclosure. Certain alternate preferred embodiments of the present invention provide a separate grab handle and/or a hook attached to the strapping or the enclosure and for use in handling or storing the helmet backpack with or without an enclosed helmet. Certain hook and grab handle designs can also be used to attach the helmet backpack to a belt or to the clothing of a user.

Optionally, the helmet backpack of the present invention may further provide separate storage compartments, which increase the usefulness of the helmet backpack by providing additional storage volume. Certain designs of these separate storage compartments are compressible and expandable, and/or detachable and attachable. The ability to detach and attach separate storage compartments allows the user to configure the storage volume of the helmet for task specific requirements.

The use of fabrics and materials as components in the helmet backpack of the present invention to display emblems, logos and/or signage is of significant commercial importance. The popularity of designer label identification by sectors of the consumer market and the desire of many consumers to express an affiliation with or appreciation of a specific social stratum or movement, political or ethnic group, corporation, sports team, design house or product manufacturer can significantly increase the monetary value of particular models of helmet backpacks constructed in accordance with the present invention and marked with signage such as an emblem, logo or other trade dress. In addition, the promotional interests of a wide range of social organizations, charities, corporations, product manufacturers, advertisers and others are advanced by the dissemination of preferred embodiments of the present invention exhibiting or bearing specific mottoes, emblems, logos, trade dress and/or other signage. The inclusion of compression molding and the use of markable materials such as neoprene, nylon, spandex or other suitable material is especially beneficial for the manufacture of preferred embodiments of the present invention that present an emblem, a logo and/or other signage.

DETAILED DESCRIPTION OF THE INVENTION

Figure 1:
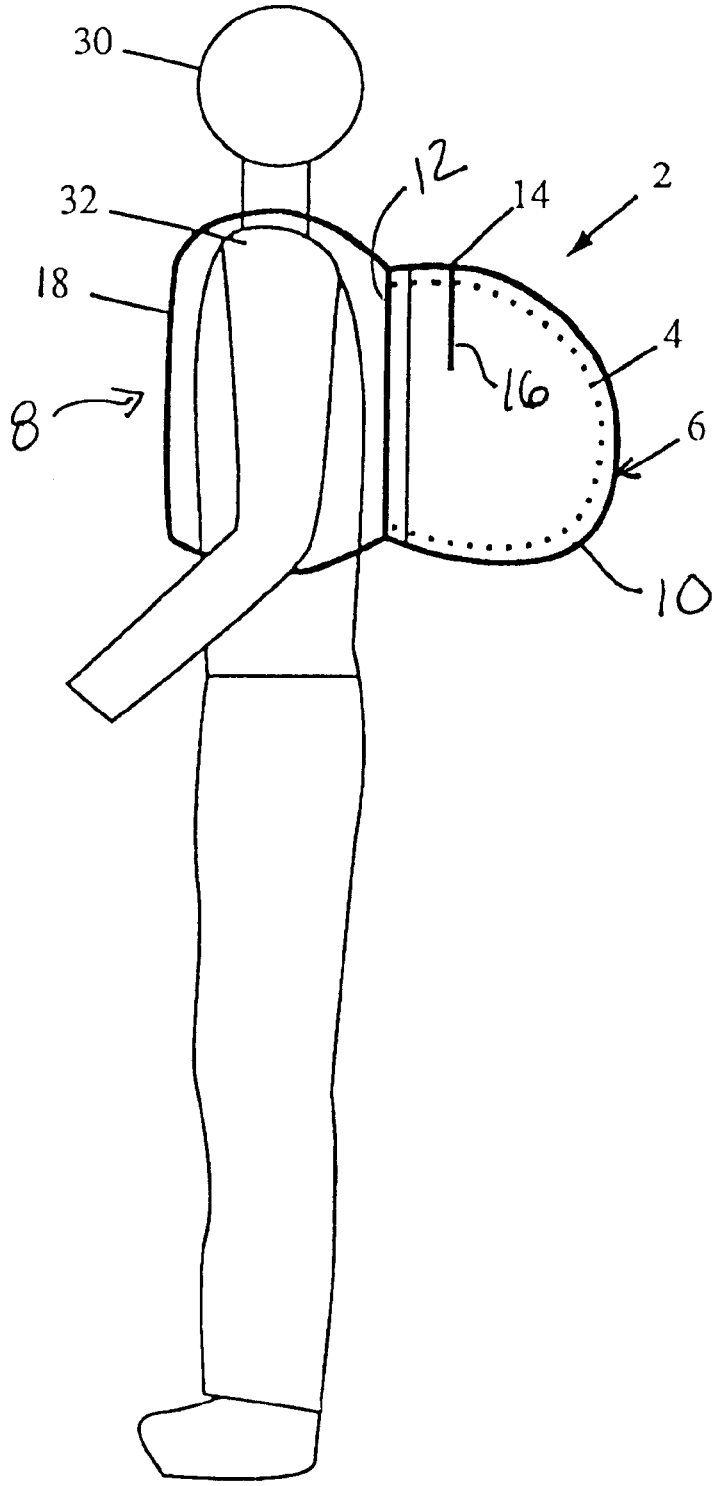
FIG. 1 illustrates the helmet backpack of the present invention being worn while securing a helmet.

FIGS. 1 through 8 illustrate various aspects and features of the helmet backpack 2 of the present invention. In each of the drawing figure, like features are given like reference numbers. The various aspects and features of the helmet backpack 2 illustrated in FIGS. 1 through 8 and/or described below are intended for use separately or in combination with one another.

Referring to FIG. 1, helmet backpack 2 is depicted being worn by a wearer 30. Helmet backpack 2 includes an enclosure 6 and strapping 8. Enclosure 6 is composed of shell 10 and backing 12. Strapping 8 may include two individual straps 18. The shell 10 and backing 12 may be constructed of a soft and stretchable or compliant material, a hard material, a foamed or padded material, or a combination or composite of these various materials. Preferably, at least the interior of the shell 10 is configured to closely conform to the dome-shaped exterior of a helmet 4. An opening 16 allows access into the interior of the enclosure 6. A zipper 14 or other closure device acts as a closing means for opening 16. Both straps 18 are placed around the shoulders 32 of wearer 30. Zipper 14 is shown in a fully closed position and a helmet 4 is thereby properly secured within enclosure 6.

Alternatively, the helmet backpack 2 of the present invention may comprise a single strap 18 rather than two or more straps 18, whereby a wearer carries the helmet backpack 2 with the single strap slung over one shoulder or slung across the front of the wearer's chest in a bandoleer style or in other suitable modes.

Figure 2:
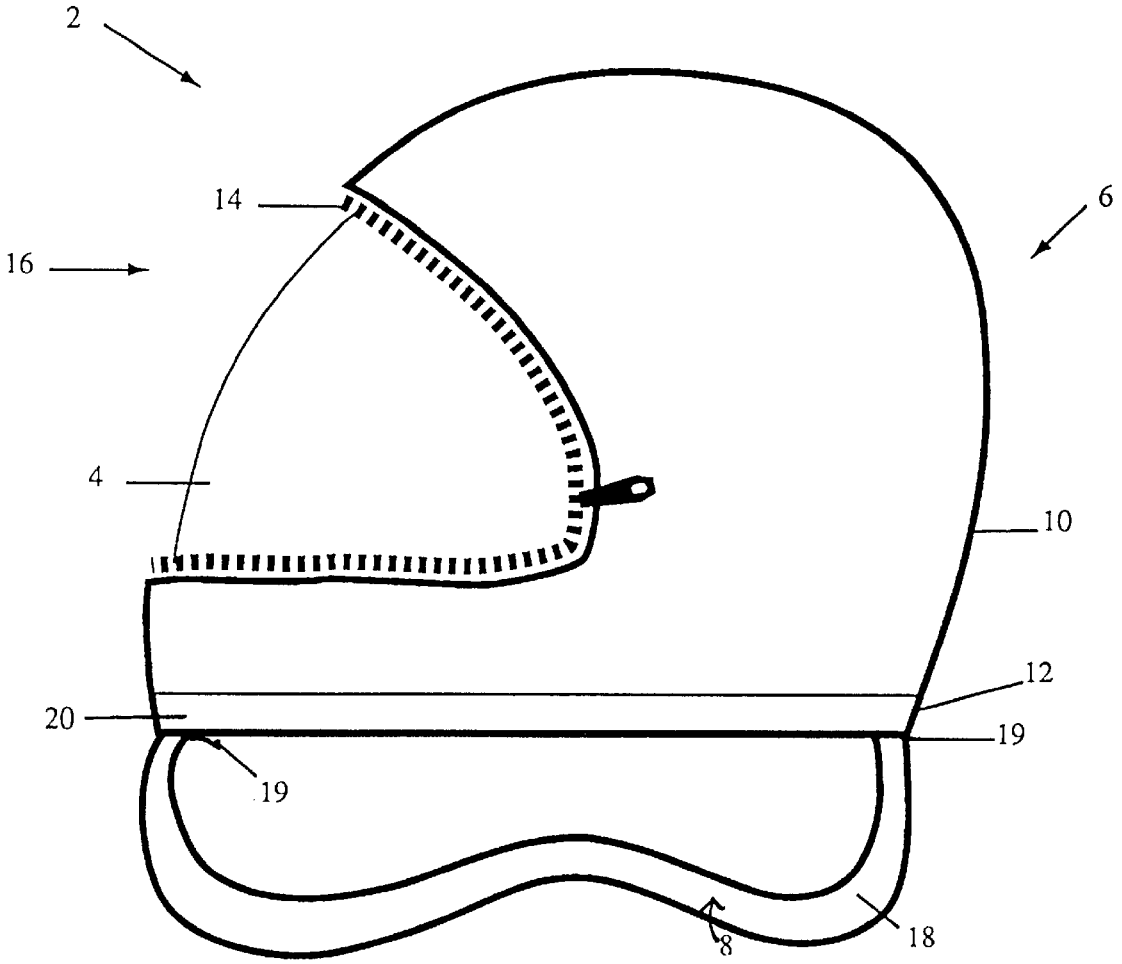
FIG. 2 illustrates construction details of the helmet backpack of FIG. 1 incorporating a soft and stretchable shell.

FIG. 2 illustrates construction details of the helmet backpack 2 of FIG. 1 incorporating a soft and stretchable shell 10. The helmet backpack 2 is shown to be partially enclosing a helmet 4. Helmet backpack 2 includes enclosure 6 and strapping 8. Enclosure 6 is composed of shell 10 and backing 12. Strapping 8 includes two individual straps 18.

Zipper 14 acts as a closing means for opening 16. Zipper 14 may be made of metallic, plastic and/or composite components. Zipper 14 is shown to be in an open state in FIG. 1 where helmet 4 is not fully contained by enclosure 6. Opening 16 may be placed, with and without a closing means, at various locations of enclosure 6 in alternate preferred embodiments of the present invention. Alternate embodiments of the helmet backpack 2 may employ button and buttonhole assemblies, hook-and-eye assemblies, zip-lock seals, hook-and-loop fasteners and other suitable closing means known in the art.

Shell 10 is composed of a soft stretchable yet resilient material or fabric such as neoprene, stretchable terry cloth, spandex, natural or synthetic rubber or other suitable materials known in the art. The material of shell 10 forms and/or stretches around the rigid shape of helmet 4 and conforms to the outside shape of helmet 4. The resilient quality of the material of shell 10 insures that helmet 4 is held firmly against backing 12 and within helmet backpack 2 when zipper 14 is placed in a closed position.

Backing 12 is constructed with strong flexible fabric or material such as canvas, terry cloth, spandex, neoprene or other suitable materials. Optionally, the backing 12 may include padding 20. Padding 20 is made of a compressible and resilient padding or foam such as natural or synthetic rubber, plastic foam, cotton, fiber batting or other suitable material. Padding 20 reduces discomfort in the wearing of helmet backpack 2 by protecting a user from irritation caused by rubbing against helmet 4. Straps 18 are attached at each end 19 to enclosure 6 and are made with a strong flexible material such as canvas, terry cloth, nylon, nylon mesh or other suitable material.

Figure 3:
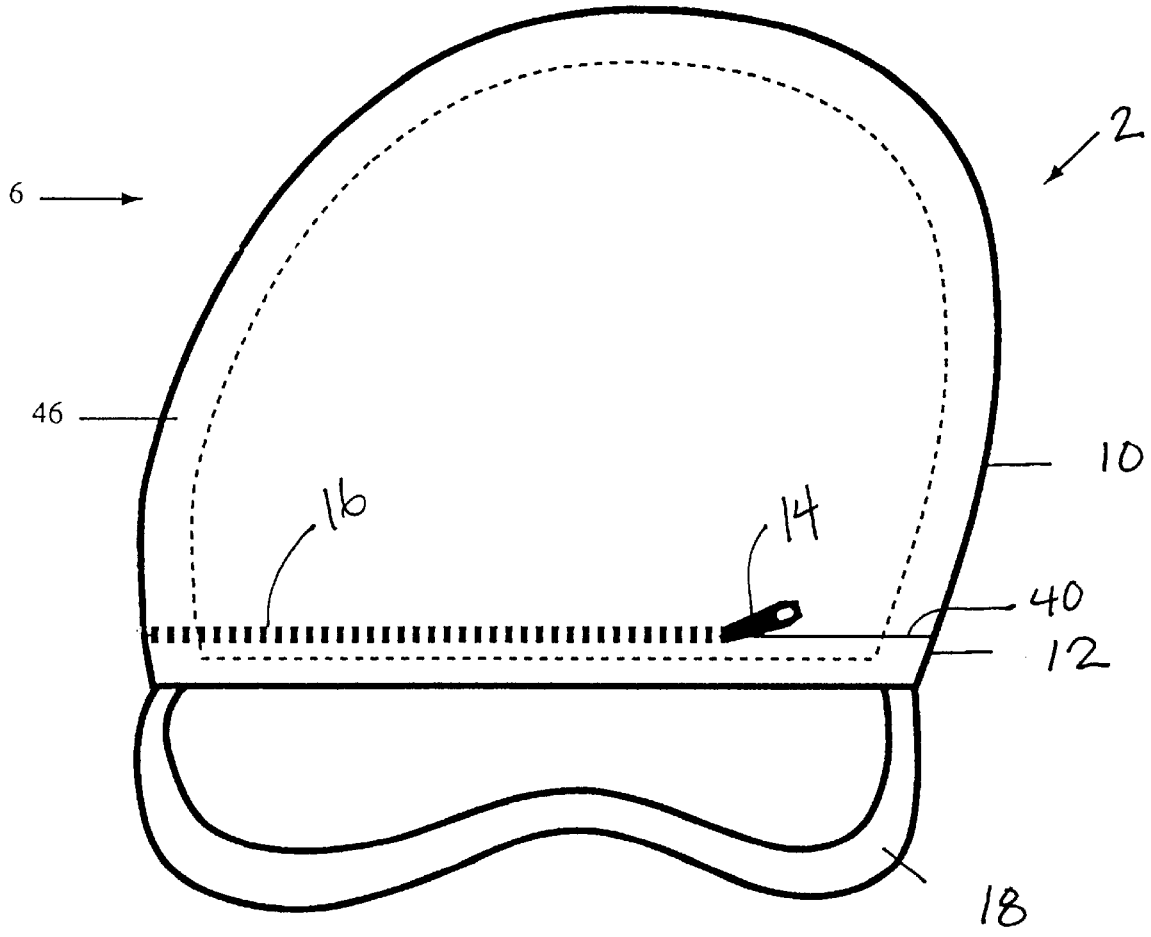
FIG. 3 illustrates construction details of the helmet backpack of FIG. 1 incorporating a rigid shell.

FIG. 3 illustrates construction details of the helmet backpack 2 of FIG. 1 incorporating a rigid shell 10. This construction of helmet backpack 2 is preferred by consumers who wish to have a hard or semi-rigid structure for the protection of their helmets. Helmet backpack 2 has an enclosure 6 that includes shell 10 and backing 12. Straps 18 may be made of canvas, cotton, nylon and/or of other suitable natural or synthetic materials. Shell 10 is constructed of metal, metal alloy, fiberglass, carbon fiber, plastic, plastic composite or other suitable rigid or semirigid material. Optionally, the backing 12 may also be constructed of a rigid or semi-rigid material. A foam layer 46 on the interior of the shell 10 and/or backing 12 presses against and conforms around the exterior of helmet 4. Foam layer 46 insures that helmet 4 is protectively secured within enclosure 6. Foam layer 46 is made of a compressible and resilient non-scratch padding or foam such as natural or synthetic rubber, plastic foam, cotton, fiber batting or other suitable material. Alternatively, the entire shell 10 and/or the backing 12 may be constructed of a rigid or flexible foam material, with or without a laminated fabric facing.

Backing 12 is constructed with strong flexible fabric or material such as canvas, terry cloth, spandex, neoprene or other suitable materials. Opening 16 is located between shell 10 and backing 12. Zipper 14 allows shell 10 to join and separate to allow a user to insert and remove helmet 4. If desired, a flexible hinge 40 may be provided between shell 10 and backing 12 to allow access into the interior of enclosure 6 through opening 16 when zipper 14 is in an opened position.

Figure 4:
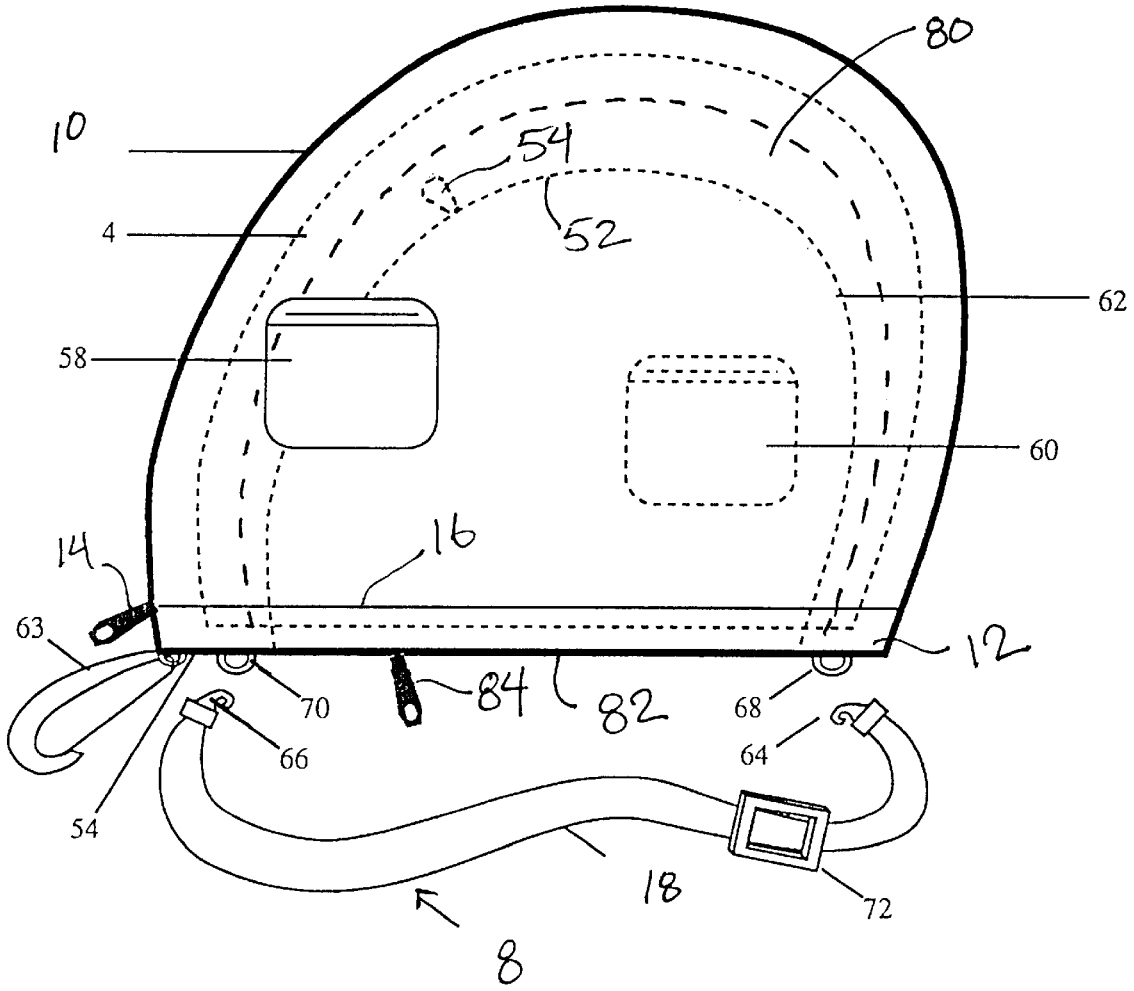
FIG. 4 illustrates the helmet backpack of FIG. 1 incorporating the additional features of pockets, a storage hook and adjustable and detachable strapping.
Figure 5:
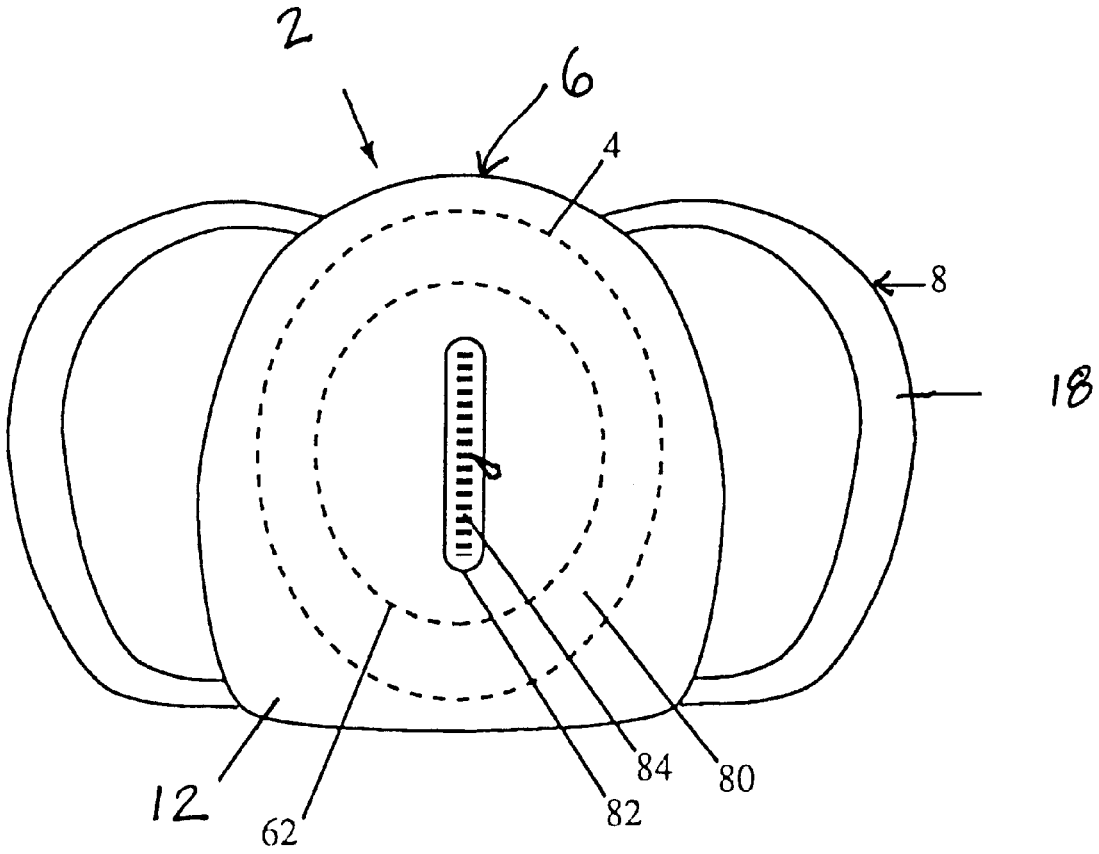
FIG. 5 is a back view of the helmet backpack of FIG. 4.

FIG. 4 illustrates the helmet backpack 2 of FIG. 1 incorporating the additional features of pockets 58, 60, 62, a storage hook 63 and adjustable and detachable strapping 8. FIG. 5 is a back view of the helmet backpack 2 of FIG. 4. Helmet backpack 2 includes shell 10, backing 12 and straps 18. Shell 10 includes external pocket 58, internal pocket 60 and interior helmet volume pocket 62. The external pocket 58 and internal pocket 60 may be permanently or detachably attached to the shell 10, as described in more detail below in connection with FIG. 7.

The interior helmet volume pocket 62 is a component of the enclosure 6 of the backpack 2 and is preferably made of a strong flexible fabric. The interior helmet volume pocket 62 extends into the interior volume 80 of the helmet 4, when the helmet 4 is placed in the backpack 2. Alternatively, the interior helmet volume pocket 62 may be made of stretchable material, allowing it to conform to the interior volume 80 of the helmet 4 when items placed in the interior helmet volume pocket 62.

The shell 10 and backing 12 may be constructed of a soft and stretchable or compliant material, a hard material, a foamed or padded material, or a combination or composite of these various materials. Preferably, at least the interior of the shell 10 is configured to closely conform to the dome-shaped exterior of a helmet 4. The straps 18 and pockets 58 and 60 are made with strong flexible fabric or material such as cotton, canvas, terry cloth, spandex, neoprene or other suitable materials.

Optionally, the straps 18 may be detachable and/or adjustable. Hooks 64 and 66 are attachable to and removable from attachment points 68 and 70. Attachment points 68 and 70 are each located on either shell 10 or backing 12. Adjustment clasps 72 allow for the adjustment of the operational length of straps 18. Sections 74 are passed through and secured by clasps 72, thereby allowing a user of the helmet backpack 2 to modify the length of each strap 56 passing around his or her shoulders.

FIG. 4 further illustrates a storage hook 63 affixed to backing 12. Storage hook 63 is used to handle, carry and/or store helmet backpack 2. Storage hook 63 is used to attach helmet backpack 2 to a belt, or to an article of clothing, or to a storage location or feature. Storage hook 63 may also be provided with a lock for securing the helmet backpack 2 to a storage location, such as a luggage rack on a motorcycle.

FIG. 5 is a back view of helmet backpack 2. FIG. 5 illustrates the position of interior helmet volume pocket 62 within the interior volume 80 of helmet 4. An opening 82 through backing 12 provides access to the interior of interior helmet volume pocket 62. Preferably, a hook-and-loop fastener, zipper 84 or other closure device is provided to open and close backing opening 82. Alternatively, backing opening 82 may employ a drawstring, an elastic drawstring, buttons with buttonholes, hook-and-eye assemblies, snaps or other suitable closing features or mechanisms or may be made without any closing means at all. Backing opening 82 provides user access to the interior helmet volume pocket 62 and allows a user to place objects into and remove objects from pocket 62. Additionally or alternatively, an interior opening 52 with a closure device 54 may be provided in the wall of the interior helmet volume pocket 62 for access between the interior of the enclosure 6 and the interior helmet volume pocket 62.

Figure 6:
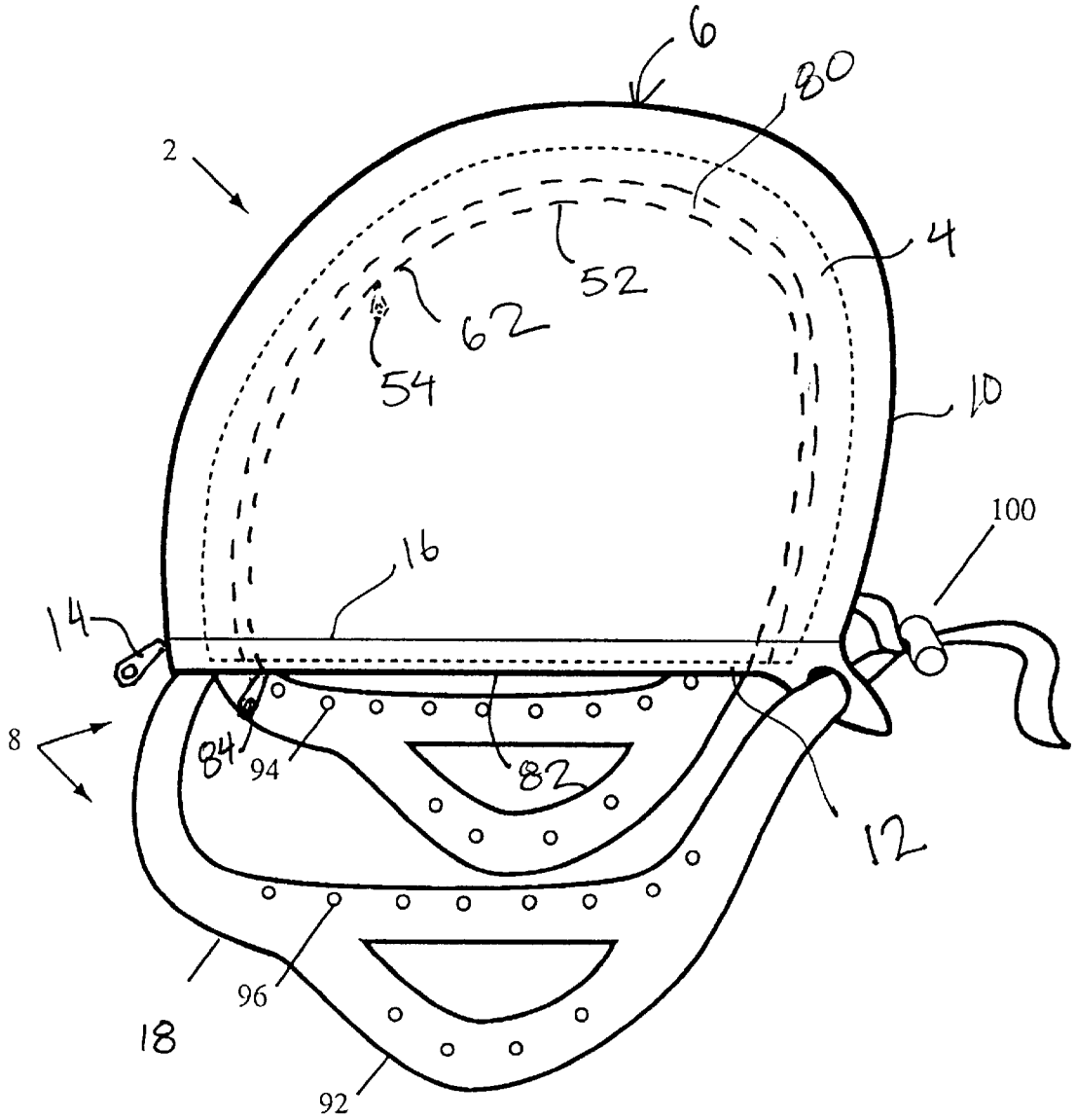
FIG. 6 illustrates the helmet backpack of FIGS. 4 and 5 incorporating the additional features of handles as components of the strapping along with drawstring-style adjustable length straps.

FIG. 6 illustrates the helmet backpack 2 of FIGS. 4 and 5 incorporating the additional features of handles 92 as components of the strapping 8 along with drawstring style adjustable length straps 18. Strapping 8 is shown to include straps 18 which each present a handle 92 for use in carrying helmet backpack 2 by hand. Furthermore, snap features 94 and 96, which are located on handles 92 and straps 18 and are joined together to join and combine handles 92 into a more comfortable and manageable handhold. Drawstring adjustment feature 100 allows the operating length of straps 18 to be adjusted.

The shell 10 and backing 12 may be constructed of a soft and stretchable or compliant material, a hard material, a foamed or padded material, or a combination or composite of these various materials. Preferably, at least the interior of the shell 10 is configured to closely conform to the dome-shaped exterior of a helmet 4. The straps 18 and pockets 58 and 60 are made with strong flexible fabric or material such as cotton, canvas, terry cloth, spandex, neoprene or other suitable materials.

Figure 7:
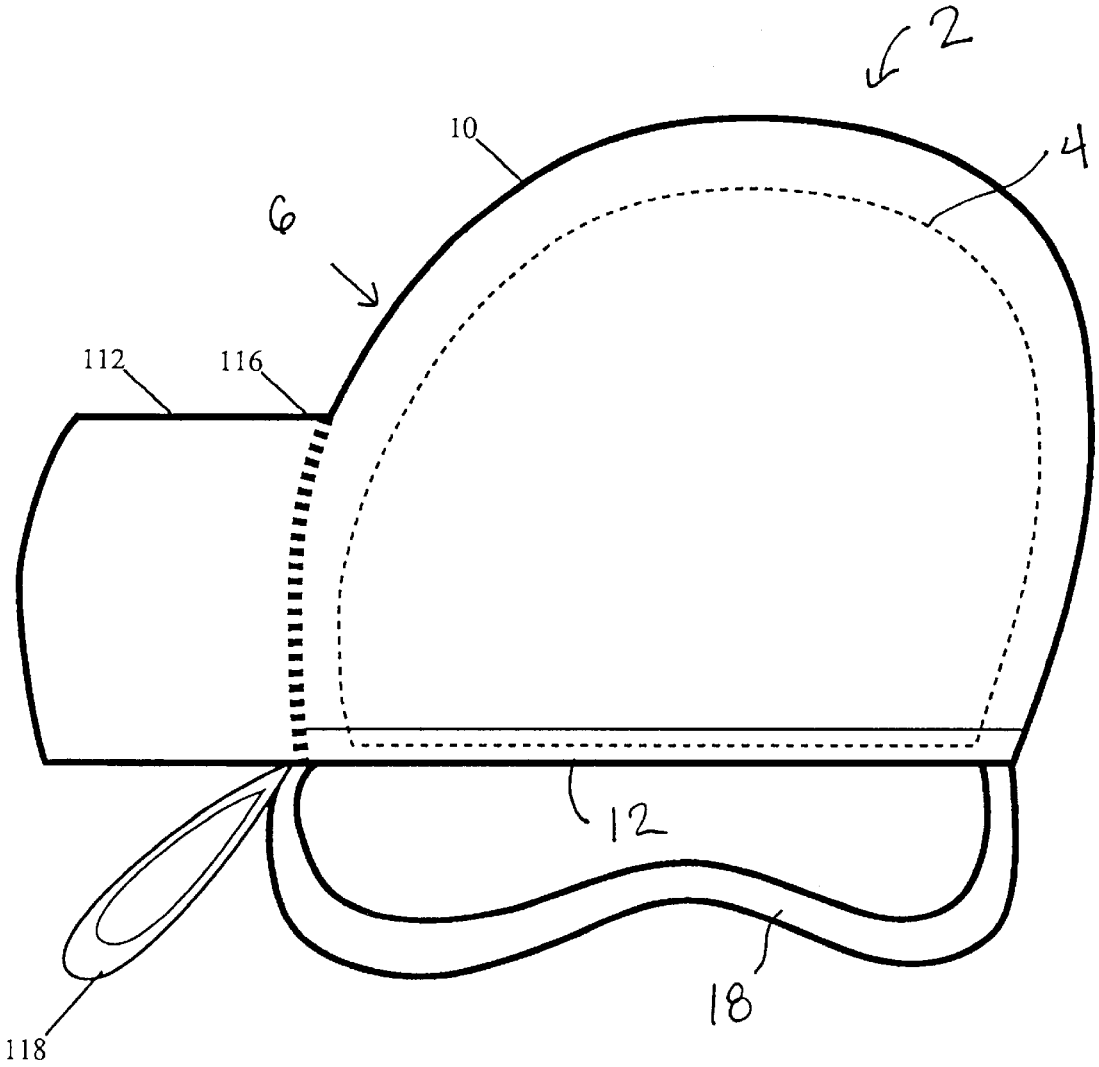
FIG. 7 illustrates the helmet backpack of FIG. 1 incorporating a grab handle feature attached to the enclosure and a detachable and attachable storage compartment.

FIG. 7 illustrates the helmet backpack 2 of FIG. 1 incorporating a detachable and attachable storage compartment 112 attached to the enclosure 6, as mentioned above in connection with FIG. 4. Detachable storage compartment 112 may be constructed of cotton, canvas, nylon, plastic foam, neoprene or other suitable materials known in the art. Detachable storage compartment 112 is detachably attached to enclosure 6 by means of buttons and buttonholes, hook-and-eye assemblies, hook-and-loop fasteners, a zipper assembly 116 or other suitable attachment means.

FIG. 7 further illustrates the helmet backpack 2 of FIG. 1 with a grab handle 118 feature attached to the enclosure 6. Grab handle 118 is used to carry, handle and/or store helmet backpack 2. Grab handle 118 is constructed of a loop of a strong, flexible material such as nylon, cotton or other suitable material. Various embodiments of grab handle 118 range in width from string-like shapes to wide strips of fabric.

The shell 10 and backing 12 may be constructed of a soft and stretchable or compliant material, a hard material, a foamed or padded material, or a combination or composite of these various materials. Preferably, at least the interior of the shell 10 is configured to closely conform to the dome-shaped exterior of a helmet 4. The straps 18 and pockets 58 and 60 are made with strong flexible fabric or material such as cotton, canvas, terry cloth, spandex, neoprene or other suitable materials.

Figure 8:
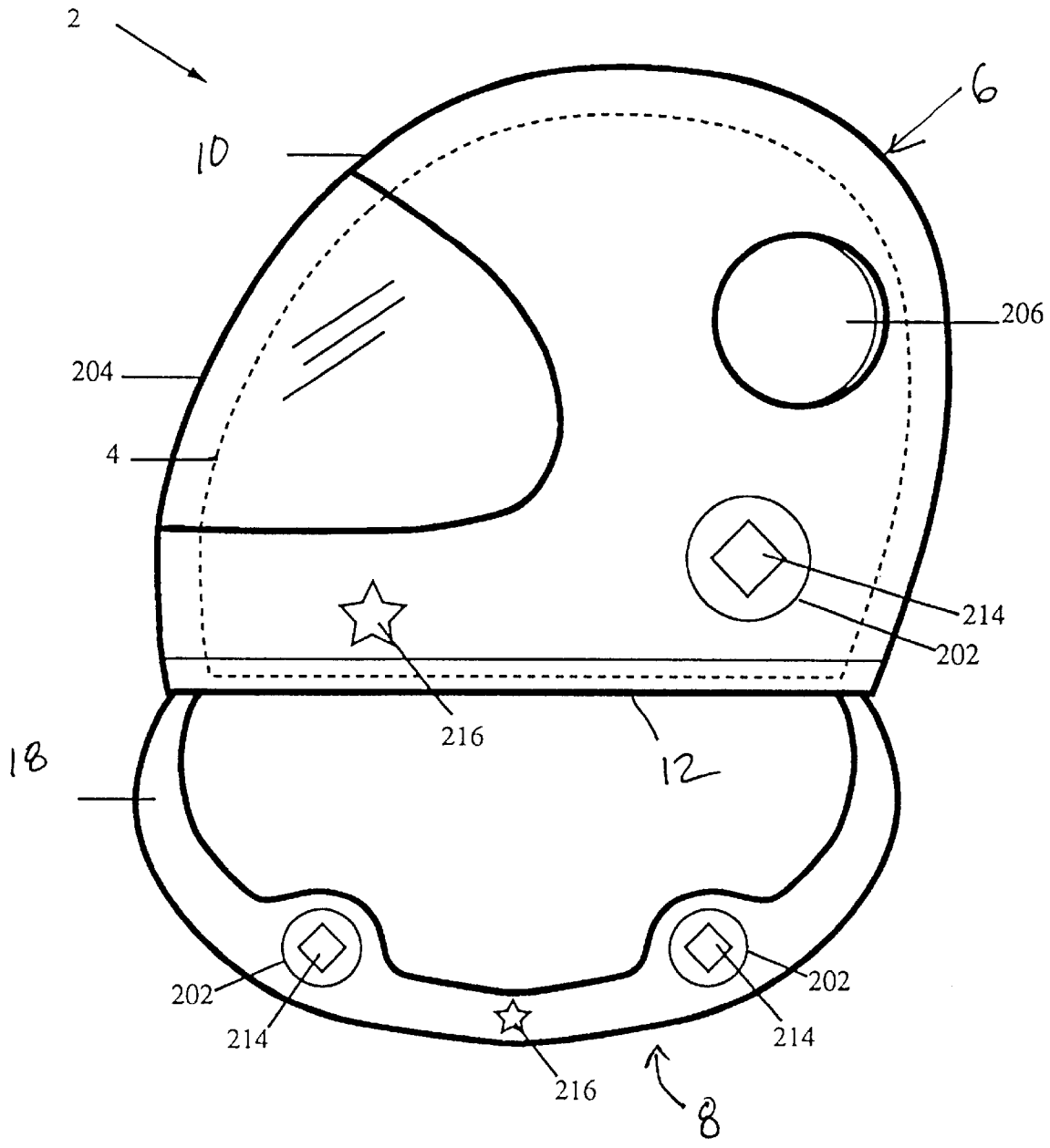
FIG. 8 illustrates the helmet backpack of FIG. 1 incorporating compression molding components in the strapping and enclosure and transparent windows and open apertures in the enclosure.

FIG. 8 illustrates the helmet backpack 2 of FIG. 1 incorporating compression molding components 202 in the strapping 8 and enclosure 6 and transparent windows 204 and open apertures 206 in the enclosure 6. Helmet backpack 2 is shown containing a helmet 4, which can be seen through transparent window 204 and open aperture 206. The transparent window 204 may be constructed of a rigid, semi-rigid or flexible material and may be clear, colored or translucent. In a particularly preferred embodiment, transparent window 204 is constructed with a clear, flexible plastic film, such mylar or vinyl. Transparent window 204 allows a portion of helmet 4 to be visible and to allow the viewing of helmet 4 for the purpose of identification, display or other aesthetic intent. Open window 206 exposes the exterior of helmet 4 to the environment outside of helmet backpack 2. This exposure is also done for the purpose of identification, display or other aesthetic intent.

The shell 10 and backing 12 may be constructed of a soft and stretchable or compliant material, a hard material, a foamed or padded material, or a combination or composite of these various materials. Preferably, at least the interior of the shell 10 is configured to closely conform to the dome-shaped exterior of the helmet 4. The straps 18 may be made with strong flexible fabric or material such as cotton, canvas, terry cloth, spandex, neoprene or other suitable materials. In one particularly preferred embodiment, the shell 10 and straps 18 are constructed of a three-layer composite of nylon, foam and a thin outer layer of nylon, lycra or other fabric, which is compatible with compression molding techniques. Compression molding is a process by which a foam or other material is thermoformed to hold a shape after being removed from the mold, thereby allowing a user to choose a decorative element or other signage to be displayed on the helmet backpack 2. This process is also referred to as foam-over molding or thermoform molding. There exist in the art other materials, fabrics and/or composites used in compression molding manufacture known and suitable for use in constructing compression molding 202. Compression molding 202 is included on strap 18 and shell 10 of helmet backpack 2 and presents logos 214. Alternatively, emblems 216 may also be displayed on the fabric of strap 18 and shell 10. Strap 18 and shell 10 are each constructed of compression molding 202, as described above, or compression molding 202 in combination with a strong flexible material or fabric such as spandex, neoprene, nylon, cotton, canvas, terry cloth or other suitable material.

While the present invention has been described herein with respect to the exemplary embodiments and the best mode for practicing the invention, it will be apparent to one of ordinary skill in the art that many modifications, improvements and subcombinations of the various embodiments, adaptations and variations can be made to the invention without departing from the spirit and scope thereof.

We claim:

1. In combination:

a helmet having an exterior and having an interior volume within said helmet; and a helmet pack adapted for carrying said helmet, said helmet pack comprising:

an enclosure defined by a backing portion and a shell portion joined to said backing portion;

a helmet receiving pocket defined by and within said enclosure, said helmet receiving pocket being configured to closely conform to said exterior of said helmet when said helmet is received within an interior of said helmet receiving pocket;

a first opening into said interior of said helmet receiving pocket;

an internal helmet volume pocket defined by an interior wall of fabric within said enclosure, said internal helmet volume pocket extending into said interior of said helmet receiving pocket, said internal helmet volume pocket being configured to extend into said interior volume of the said helmet when said helmet is placed into said interior of said helmet receiving pocket, an interior of said internal helmet volume pocket being separated from said interior of said helmet receiving pocket by said interior wall of fabric within said enclosure; and a second opening into said interior of said internal helmet volume pocket.

2. The combination of claim 1, wherein said second opening into said internal helmet volume pocket extends through said backing portion of said enclosure.

3. The combination of claim 1, wherein said internal helmet volume pocket within said enclosure is configured to closely conform to the interior volume of the helmet when said helmet is received within said interior of said helmet receiving pocket.

4. The combination of claim 1, wherein said interior wall of fabric separating said internal helmet volume pocket from said interior of said helmet receiving pocket is made of stretchable material.

5. The combination of claim 1, further comprising:

a first shoulder strap and a second shoulder strap attached to an exterior of said enclosure.

6. The combination of claim 5, further comprising:

a first handle attached to said first shoulder strap and a second handle attached to said second shoulder strap and fastening means for fastening said first shoulder strap to said second shoulder strap and for fastening said first handle to said second handle to form a single hand hold.

7. The combination of claim 1, further comprising:

a first closing means for closing said first opening into said interior of said helmet receiving pocket.

8. The combination of claim 1, further comprising:

a second closing means for closing said second opening into said internal helmet volume pocket.

9. The combination of claim 1, further comprising:

a first closing means for closing said first opening into said interior of said helmet receiving pocket; and a second closing means for closing said second opening into said internal helmet volume pocket.

10. The combination of claim 1, wherein said second opening into said internal helmet volume pocket extends through said interior wall of fabric separating said internal helmet volume pocket from said interior of said helmet receiving pocket.

11. The combination of claim 1, further comprising:

an external pocket on an exterior of said enclosure.

12. The combination of claim 1, further comprising:

an inner pocket on an interior of said enclosure.

13. The combination of claim 1, further comprising:

a detachable storage compartment removably attached to an exterior of said enclosure.

14. The combination of claim 1, wherein said backing portion of said enclosure is constructed of a material selected from the group consisting of cotton, canvas, terry cloth, spandex and neoprene.

15. The combination of claim 1, wherein said backing portion of said enclosure is padded.

16. The combination of claim 1, wherein said shell portion of said enclosure is constructed of a material selected from the group consisting of stretchable terry cloth, spandex, natural rubber, synthetic rubber and neoprene.

17. The combination of claim 1, wherein said shell portion of said enclosure is constructed of a hard material.

18. The combination of claim 17, wherein said shell portion of said enclosure is constructed of a material selected from the group consisting of metal, metal alloy, fiberglass, carbon fiber, plastic and plastic composite.

19. The combination of claim 17, wherein said shell portion further comprises a padding layer on an interior surface facing said interior of said helmet receiving pocket.

20. The combination of claim 19, wherein said padding layer is constructed of a material selected from the group consisting of natural rubber, synthetic rubber and plastic foam.

21. The combination of claim 1, wherein said shell portion of said enclosure is constructed of plastic foam.

22. The combination of claim 1, wherein said shell portion of said enclosure is constructed of a stretchable material.

23. The combination of claim 1, wherein said shell portion of said enclosure further comprises a transparent portion.

24. A helmet pack adapted for carrying a helmet of the type having an exterior and having an interior volume within the helmet, said helmet pack comprising:

an enclosure defined by a backing portion and a shell portion joined to said backing portion;

a helmet receiving pocket defined by and within said enclosure, said helmet receiving pocket being configured to receive the helmet within an interior of said helmet receiving pocket;

an internal helmet volume pocket defined by an interior wall of fabric within said enclosure, said internal helmet volume pocket extending into said interior of said helmet receiving pocket, said internal helmet volume pocket being configured to extend into the interior volume of the helmet when the helmet is placed into said interior of said helmet receiving pocket, an interior of said internal helmet volume pocket being separated from said interior of said helmet receiving pocket by said interior wall of fabric within said enclosure;

a first opening into said interior of said helmet receiving pocket;

a second opening into said interior of said internal helmet volume pocket;

a first shoulder strap and a second shoulder strap attached to an exterior of said enclosure;

a first handle attached to said first shoulder strap and a second handle attached to said second shoulder strap and fastening means for fastening said first shoulder strap to said second shoulder strap and for fastening said first handle to said second handle to form a single hand hold.

25. The helmet pack of claim 24, wherein said helmet receiving pocket within said enclosure is configured to closely conform to the exterior of the helmet when said helmet is received within said interior of said helmet receiving pocket.

26. The helmet pack of claim 24, wherein said internal helmet volume pocket within said enclosure is configured to closely conform to the interior volume of the helmet when said helmet is received within said interior of the helmet receiving pocket.

27. The helmet pack of claim 24, wherein said interior wall of fabric separating said internal helmet volume pocket from said interior of said helmet receiving pocket is made of stretchable material.

28. A helmet backpack adapted for carrying a helmet, said helmet backpack comprising:

an enclosure defined by a backing portion and a shell portion joined to said backing portion;

a helmet receiving pocket defined by and within said enclosure, said helmet receiving pocket being configured to receive the helmet within an interior of said helmet receiving pocket;

a first opening into said interior of said helmet receiving pocket;

a first shoulder strap attached to an exterior of said enclosure;

a second shoulder strap attached to said exterior of said enclosure;

a first handle attached to said first shoulder strap;

a second handle attached to said second shoulder strap; and fastening means for fastening said first shoulder strap to said second shoulder strap and for fastening said first handle to said second handle to form a single hand hold.

29. The helmet pack of claim 28, wherein said helmet receiving pocket within said enclosure is configured to closely conform to the exterior of a helmet when the helmet is received within said interior of said helmet receiving pocket.

* * * * *